US009993670B2

(12) United States Patent
Kozuki

(10) Patent No.: US 9,993,670 B2
(45) Date of Patent: Jun. 12, 2018

(54) LANYARD AND SAFETY BELT INCLUDING THE LANYARD

(71) Applicant: FUJII DENKO CO., LTD., Kato, Hyogo (JP)

(72) Inventor: Akitomo Kozuki, Kato (JP)

(73) Assignee: FUJII DENKO CO., LTD., Kato, Hyogo (JP)

( * ) Notice: Subject to any disclaimer, the term of this patent is extended or adjusted under 35 U.S.C. 154(b) by 363 days.

(21) Appl. No.: 14/765,312

(22) PCT Filed: Jan. 16, 2014

(86) PCT No.: PCT/JP2014/050612

§ 371 (c)(1),
(2) Date: Jul. 31, 2015

(87) PCT Pub. No.: WO2014/171157

PCT Pub. Date: Oct. 23, 2014

(65) Prior Publication Data

US 2015/0375021 A1 Dec. 31, 2015

(30) Foreign Application Priority Data

Apr. 18, 2013 (JP) ..... 2013-087213

(51) Int. Cl.
*A62B 35/00* (2006.01)

(52) U.S. Cl.
CPC ..... *A62B 35/0093* (2013.01); *A62B 35/0037* (2013.01); *A62B 35/0043* (2013.01); *A62B 35/0075* (2013.01)

(58) Field of Classification Search
CPC .. A62B 1/00; A62B 1/02; A62B 1/061; A62B 1/14; A62B 35/0093; A62B 35/0006
See application file for complete search history.

(56) References Cited

U.S. PATENT DOCUMENTS

2005/0051659 A1* 3/2005 Wolner ..... A62B 1/10 242/383.5
2007/0151805 A1* 7/2007 Betcher ..... A62B 35/0093 182/239

(Continued)

FOREIGN PATENT DOCUMENTS

JP 7-45234 Y2 10/1995
JP 9-323618 A 12/1997

(Continued)

OTHER PUBLICATIONS

International Search Report, issued in PCT/JP2014/050612, dated Mar. 4, 2014.

*Primary Examiner* — Katherine W Mitchell
*Assistant Examiner* — Candace L Bradford
(74) *Attorney, Agent, or Firm* — Birch, Stewart, Kolasch & Birch, LLP

(57) ABSTRACT

In a reel 24 of a lanyard, a cam 46 is rotatable to change an orientation among a free orientation, a locking orientation, and a waiting orientation. The free orientation represents an orientation in which the cam 46 can be rotated in any of directions. The locking orientation represents an orientation in which a locking engagement portion 82 engages with a latching portion 96 of a cam receiver 52. The waiting orientation represents an orientation in which a waiting engagement portion 84 engages with a plate spring 48. When the bobbin rotates in one direction, the cam 46 changes from the free orientation to the waiting orientation. When the bobbin rotates in the other direction, a tip 82*a* of the cam 46 in the waiting orientation is guided by a guiding surface 100, to change the cam 46 from the waiting orientation to the locking orientation.

12 Claims, 14 Drawing Sheets

(56) References Cited

U.S. PATENT DOCUMENTS

| | | | | |
|---|---|---|---|---|
| 2009/0211847 | A1* | 8/2009 | Balquist | A62B 35/0093 182/231 |
| 2011/0100755 | A1* | 5/2011 | Meillet | A62B 1/10 182/234 |
| 2013/0277631 | A1* | 10/2013 | Luntz | B66D 3/046 254/391 |
| 2016/0310767 | A1* | 10/2016 | Resch | A62B 1/14 |

FOREIGN PATENT DOCUMENTS

| | | | |
|---|---|---|---|
| JP | 10-305109 | A | 11/1998 |
| JP | 3097943 | U | 2/2004 |

* cited by examiner (b)

(a)

LANYARD AND SAFETY BELT INCLUDING THE LANYARD

TECHNICAL FIELD

The present invention relates to lanyards used for works in high places. More specifically, the present invention relates to lanyards including reels and safety belts including the lanyards.

BACKGROUND ART

Workers wear safety belts in high workplaces. To the safety belts, lanyards are connected. Hooks of the lanyards engage with structures, lifelines, or the like. Thus, even if a worker makes a misstep, falling from a high place is prevented. The safety belts enable prevention of falling accidents.

A work in a high place is performed, in a working range having some degree of width, by a worker moving in the range. A strap of the lanyard is made slack to some degree so as to allow movement in the working range. When the strap is very slack, the strap may be caught by a building. Further, if a worker makes a misstep, a falling distance may be increased by a distance corresponding to the slack. Therefore, the slack of the strap is preferably minimized. On the other hand, when the slack of the strap is too small, a worker is pulled by the lanyard during work. Working efficiency is reduced.

Lanyards including reels are used. The reel stores a strap of the lanyard. The strap can be extracted and wound. Further, reels including locking mechanisms are used. The locking mechanism regulates winding of a strap. The strap is wound by the reel, thereby reducing excessive slack of the strap. Further, an operation lever of the locking mechanism is operated, thereby preventing winding of the strap. A worker is less likely to be pulled by the lanyard during work. Thus, working efficiency is less likely to be reduced.

In the lanyard including the locking mechanism, unlocking operation and locking operation are performed when a workplace is changed. In the operations, the operation lever of the locking mechanism is operated. It is bothersome for a worker to frequently operate the operation lever.

In Japanese Examined Utility Model Publication No. 7-45234, a reel is suggested which includes a ratchet toothed member a portion of which is cut out in the circumferential direction, and a cam that engages with the ratchet toothed member. The reel is used for a lanyard. In the reel, the ratchet toothed member and the cam engage with each other to prevent winding of a strap. At a position where the portion of the ratchet toothed member is cut out, an engagement direction of the cam can be changed. At the position, the engagement direction is switched between a direction in which the cam engages with the ratchet toothed member and a direction in which the cam does not engage with the ratchet toothed member. When, at this position, the cam is switched to be oriented in the direction in which the cam does not engage with the ratchet toothed member, the strap can be wound.

In the reel, the ratchet toothed member contacts with the cam, whereby the ratchet toothed member supports the cam in such an orientation that the cam can be locked. In the orientation, the strap can be extracted. On the other hand, when the strap has been wound, the ratchet toothed member and the cam engage with each other, to prevent the winding. In order to cancel the prevention of the winding, the strap is extracted until the cam reaches the position at which the portion of the ratchet toothed member is cut out. At the position, the engagement direction of the cam is changed. The winding of the strap is started at this position.

The locking mechanism does not require an operation of a lever for operating the locking mechanism. When the strap is extracted by a worker, locking and unlocking operations for the locking mechanism are performed. The reel facilitates operation of the locking mechanism.

CITATION LIST

Patent Literature

Patent Literature 1: Japanese Examined Utility Model Publication No. 7-45234

SUMMARY OF THE INVENTION

Problems to be Solved by the Invention

In the reel, the cam needs to be aligned with the position at which the portion of the ratchet toothed member is cut out, in order to wind the strap. When the cam is moved beyond the position, the cam is supported again by the ratchet toothed member and maintained in such an orientation that the cam can be locked. Time and effort are sometimes required for aligning, in the reel, the cam with the position at which the portion of the ratchet toothed member is cut out, when the strap is wound. On the other hand, when the cut portion of the ratchet toothed member is increased in the circumferential direction, time and effort are required for alignment with a position at which the cam is supported by the ratchet toothed member.

An object of the present invention is to provide a lanyard including a reel that facilitates operations for preventing winding of a strap and canceling the prevention of the winding of the strap, and a safety belt including the lanyard.

Solution to the Problems

A lanyard according to the present invention includes: a hook; a strap connected to the hook; and a reel by which the strap is wound. The reel includes a bobbin, a frame, a cam, a cam elastic member, and a cam receiver. The bobbin is rotatable, in a circumferential direction thereof, relative to the frame. The bobbin rotates in one direction such that the strap is extracted, and rotates in another direction to wind the strap. One of the cam and the cam receiver is rotatable together with the bobbin. The other of the cam and the cam receiver is integrated with the frame. The cam includes a locking engagement portion and a waiting engagement portion. The cam is rotatably supported. A rotation shaft of the cam is disposed parallel to a rotation shaft of the bobbin. The cam receiver includes a latching portion, a projecting portion, and a guiding surface. The latching portion of the cam receiver is farther from the rotation shaft of the cam in a radial direction than the projecting portion is. The guiding surface is positioned between the projecting portion and the latching portion in the radial direction. The guiding surface faces in a direction from which the cam approaches the guiding surface when the bobbin rotates in the other direction in the circumferential direction. The cam is rotatable to change an orientation among a free orientation, a locking orientation, and a waiting orientation. The free orientation represents an orientation in which the cam can be rotated in any of directions. The locking orientation represents an orientation in which a tip of the locking engagement portion is oriented in a direction toward the cam receiver when the bobbin rotates in the other direction, and the locking engagement portion engages with the latching portion of the cam receiver. The waiting orientation represents an orientation in which the tip of the locking engagement portion is oriented in the direction toward the cam receiver when the bobbin rotates in the other direction, and the waiting engagement portion engages with the cam elastic member. When the bobbin rotates in one direction in the circumferential direction, the cam is rotated by the projecting portion, to change an orientation from the free orientation to the waiting orientation. When the bobbin rotates in the other direction in the circumferential direction, the tip of the locking engagement portion of the cam in the waiting orientation is guided by the guiding surface, to change the orientation from the waiting orientation to the locking orientation. In the locking orientation, the waiting engagement portion of the cam and the cam elastic member are disengaged from each other, and the cam is urged by the cam elastic member in a rotation direction in which the locking orientation is changed to the free orientation. A distance from an axial center of the rotation shaft of the cam to the tip of the locking engagement portion is longer than a minimum distance, in the radial direction, from the axial center of the rotation shaft of the cam to the latching portion.

Preferably, the cam receiver includes a support surface. The support surface is formed so as to continuously connect to the latching portion. The support surface supports the tip of the locking engagement portion so as to orient the tip in a direction toward the latching portion when the tip of the locking engagement portion of the cam that engages with the latching portion of the cam receiver, moves away from the latching portion in one direction in the circumferential direction.

Preferably, the guiding surface extends in the radial direction.

Preferably, the guiding surface extends so as to be titled from one side toward another side in the rotation direction of the bobbin, in a direction in which a distance from the rotation shaft is increased in the radial direction.

Preferably, an angle θ representing a width of the support surface in the rotation direction is greater than or equal to 5°, and not greater than 30°.

Preferably, the reel includes a fixing plate. The rotation shaft of the cam and the cam elastic member are fixed to the fixing plate. One of the fixing plate and the cam receiver is rotatable integrally with the bobbin, and the other of the fixing plate and the cam receiver is integrated with the frame.

Preferably, the fixing plate includes a stopper. The stopper restricts elastic deformation of the cam elastic member.

Preferably, both ends of the cam elastic member are fixed. A bent portion is formed, in the cam elastic member, between both the ends so as to project toward the cam in the radial direction. An engagement portion that engages with the cam is formed in the bent portion.

Preferably, the cam elastic member is a plate spring that extends between both the ends. The stopper is a groove formed in the fixing plate. A pair of wall surfaces in the groove extends along one end to the other end of the plate spring. The plate spring is positioned between the paired wall surfaces.

Preferably, the reel includes a case fixed integrally with the frame. The cam receiver is integrated with the case.

Preferably, the two or more cam receivers are provided so as to be spaced from each other in the rotation direction.

A harness type safety belt according to the present invention includes a lanyard and a harness. The lanyard includes: a hook; a strap connected to the hook; and a reel by which the strap is wound. The reel includes a bobbin, a frame, a cam, a cam elastic member, and a cam receiver. The bobbin is rotatable, in a circumferential direction thereof, relative to the frame. The bobbin rotates in one direction such that the strap is extracted, and rotates in another direction to wind the strap. One of the cam and the cam receiver is rotatable together with the bobbin. The other of the cam and the cam receiver is integrated with the frame. The cam includes a locking engagement portion and a waiting engagement portion. The cam is rotatably supported. A rotation shaft of the cam is disposed parallel to a rotation shaft of the bobbin. The cam receiver includes a latching portion, a projecting portion, and a guiding surface. The latching portion of the cam receiver is farther from the rotation shaft of the cam in a radial direction than the projecting portion is. The guiding surface is positioned between the projecting portion and the latching portion in the radial direction. The guiding surface faces in a direction from which the cam approaches the guiding surface when the bobbin rotates in the other direction in the circumferential direction. The cam is rotatable to change an orientation among a free orientation, a locking orientation, and a waiting orientation. The free orientation represents an orientation in which the cam can be rotated in any of directions. The locking orientation represents an orientation in which a tip of the locking engagement portion is oriented in a direction toward the cam receiver when the bobbin rotates in the other direction, and the locking engagement portion engages with the latching portion of the cam receiver. The waiting orientation represents an orientation in which the tip of the locking engagement portion is oriented in the direction toward the cam receiver when the bobbin rotates in the other direction, and the waiting engagement portion engages with the cam elastic member. When the bobbin rotates in one direction in the circumferential direction, the cam is rotated by the projecting portion, to change an orientation from the free orientation to the waiting orientation. When the bobbin rotates in the other direction in the circumferential direction, the tip of the locking engagement portion of the cam in the waiting orientation is guided by the guiding surface, to change the orientation from the waiting orientation to the locking orientation. In the locking orientation, the waiting engagement portion of the cam and the cam elastic member are disengaged from each other, and the cam is urged by the cam elastic member in a rotation direction in which the locking orientation is changed to the free orientation. A distance from an axial center of the rotation shaft of the cam to the tip of the locking engagement portion is longer than a minimum distance, in the radial direction, from the axial center of the rotation shaft of the cam to the latching portion. The harness includes a shoulder belt portion and a thigh belt portion, and the shoulder belt portion forms an intersecting portion by the shoulder belt portion making an intersection and overlap on a back portion. The lanyard is connected to the intersecting portion of the harness.

Advantageous Effects of the Invention

In the lanyard of the present invention, the strap is extracted and the cam contacts with the projecting portion, thereby maintaining the cam in the waiting orientation. When the strap is wound, the cam in the waiting orientation is guided by the guiding surface, and engages with the cam receiver, to enter the locking orientation, thereby preventing winding of the strap. Further, when the strap is extracted and the cam enters the free orientation, the strap is wound. In the reel of the lanyard, prevention of winding of the strap and cancellation of the prevention of winding of the strap are facilitated.

DESCRIPTION OF EMBODIMENTS

Figure 1:
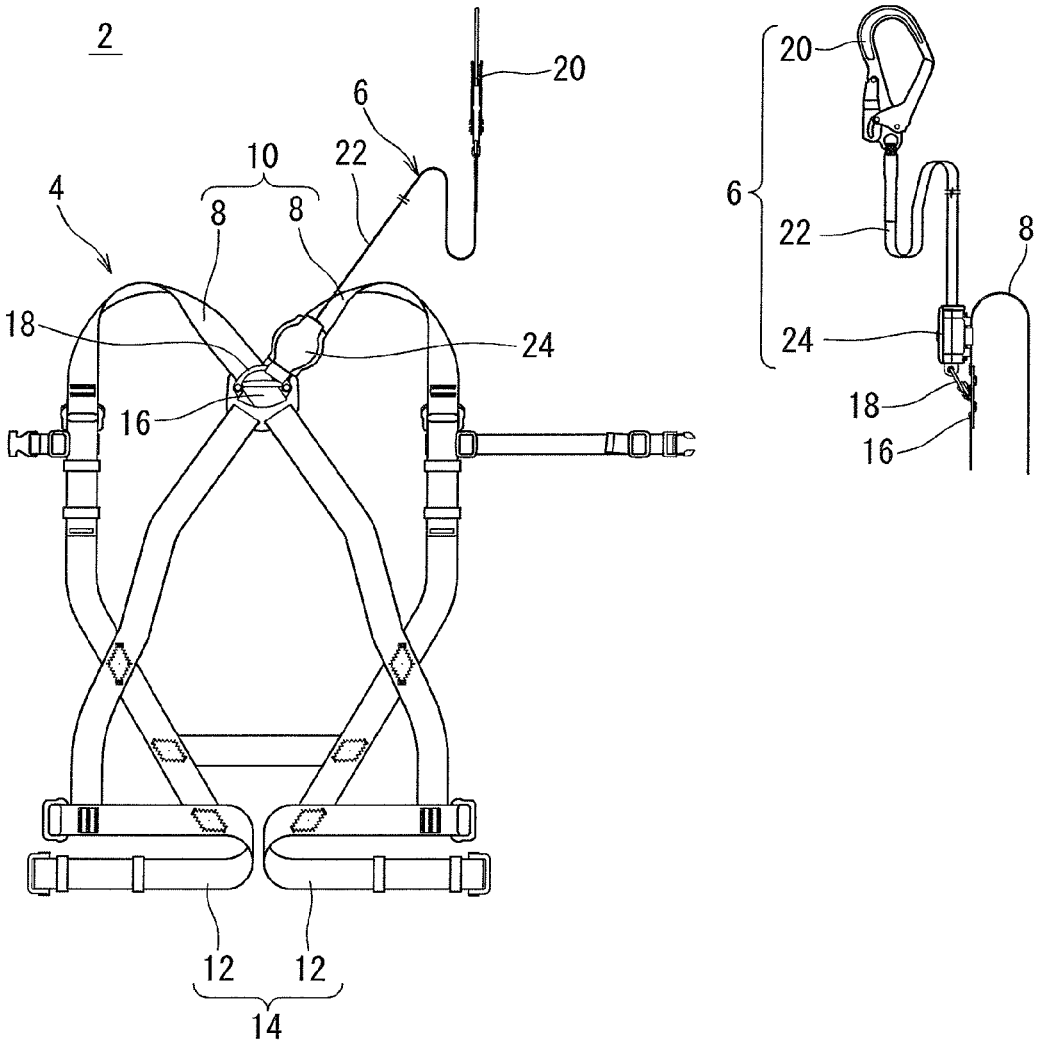
FIG. 1 illustrates a harness type safety belt according to one embodiment of the present invention.

The following will describe in detail the present invention based on preferred embodiments with reference to the drawing as appropriate.

A harness type safety belt 2 shown in FIG. 1 includes a harness 4 and a lanyard 6. The harness 4 includes a shoulder belt portion 10 and a thigh belt portion 14. The shoulder belt portion 10 includes a pair of shoulder belts 8. The thigh belt portion 14 includes a pair of thigh belts 12. The paired shoulder belts 8 intersect and overlap each other on the back portion of a worker wearing the shoulder belts 8. By the shoulder belts 8 intersecting and overlapping each other, an intersecting portion 16 is formed. A D-ring 18 is attached to the intersecting portion 16.

The lanyard 6 includes a hook 20, a strap 22, and a reel 24. The strap 22 is wound by the reel 24. The leading end of the strap 22 to be extracted from the reel 24 is connected to the hook 20. The reel 24 is connected to the D-ring 18 of the harness type safety belt 2.

Figure 2:
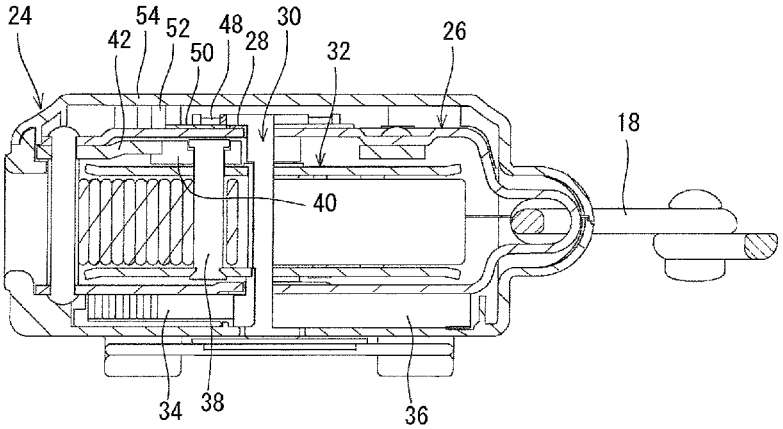
FIG. 2 is a cross-sectional view of a reel of the safety belt shown in FIG. 1.
Figure 3:
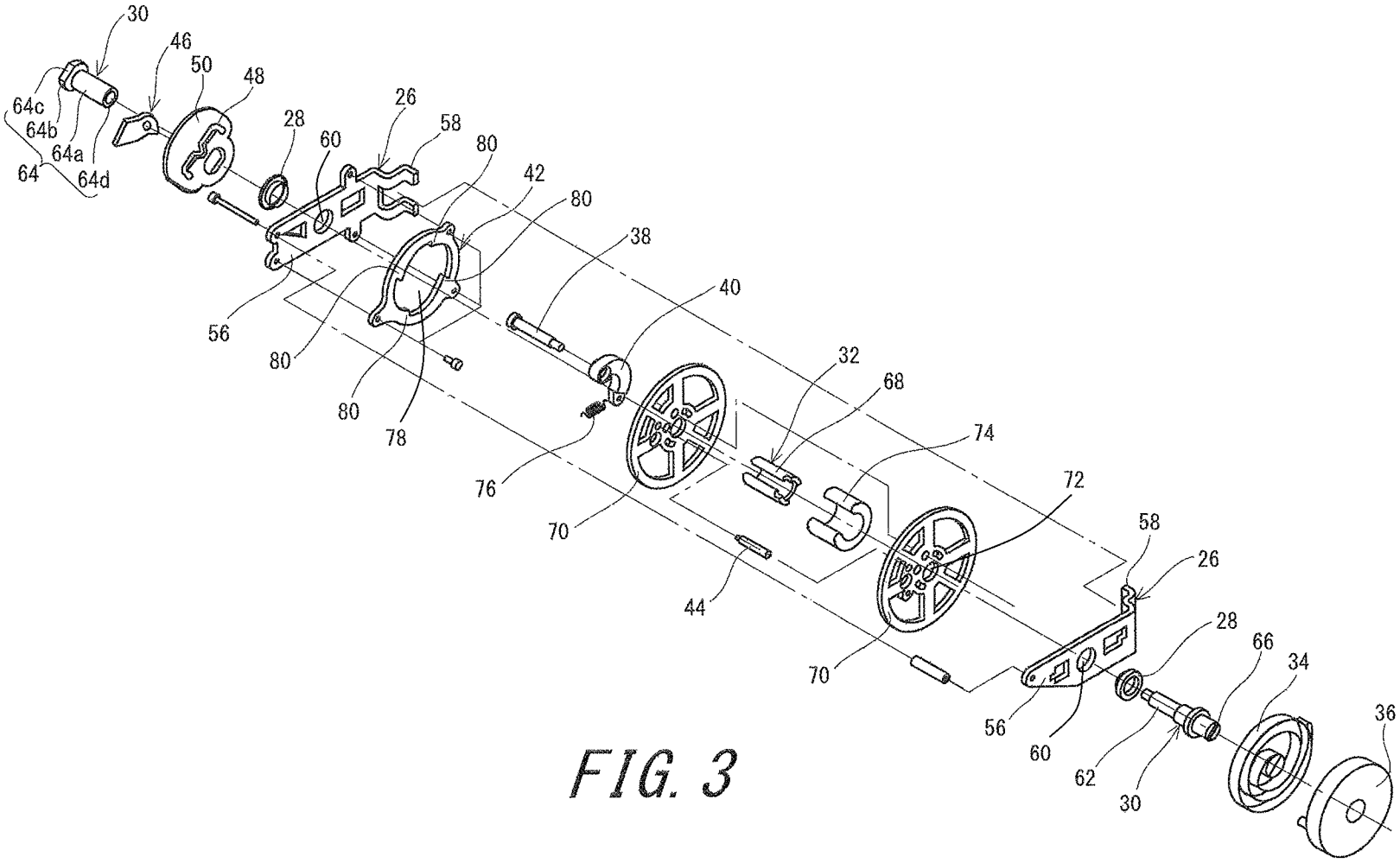
FIG. 3 is a partially exploded view of the reel of the safety belt shown in FIG. 1.

As shown in FIG. 2 and FIG. 3, the reel 24 includes a frame 26, shaft receivers 28, a main shaft 30, a bobbin 32, a spiral spring 34, a spring case 36, a claw piece shaft 38, a claw piece 40, a claw piece receiving gear 42, a stepped rivet 44, a cam 46, a plate spring 48, and a fixing plate 50. Further, as shown in FIG. 2, the reel 24 includes a cam receiver 52 and a case 54.

As shown in FIG. 2, the cam receiver 52 is fixed to the case 54. The case 54 is fixed integrally with the frame 26. The case 54 covers other components such as the frame 26, the shaft receivers 28, the main shaft 30, the bobbin 32, the spiral spring 34, and the spring case 36. The cam receiver 52 and the case 54 are each formed from a resin. The cam receiver 52 is formed integrally with the case 54.

As shown in FIG. 3, the frame 26 includes a pair of plates 56 and connection portions 58 by which the paired plates 56 are connected to each other. The paired plates 56 have flat surfaces disposed parallel and opposed to each other. The paired plates 56 have main shaft holes 60. The connection portions 58 are each bent so as to be almost U-shaped. The frame 26 is formed from a metal. The shaft receivers 28 are inserted and fixed in the main shaft holes 60 of the frames 26. The shaft receivers 28 are formed from a resin.

The main shaft 30 includes a shaft body 62 and a stepped bush 64. The shaft body 62 and the stepped bush 64 are each formed from a metal. The leading end of the shaft body 62 is inserted into one of the shaft receivers 28. In the rear end of the shaft body 62, a groove 66 is formed so as to be parallel to the axis line direction. The stepped bush 64 includes a small-diameter portion 64*a* and a large-diameter portion 64*b* disposed at an end portion on a side opposite to the small-diameter portion 64*a* side. The large-diameter portion 64*b* is a head portion of the stepped bush 64. On the outer circumferential surface of the large-diameter portion 64*b*, a chamfered portion 64*c* is formed. The stepped bush 64 has a hole 64*d* that passes through its axis line. Into the hole 64*d*, the head portion of the shaft body 62 is inserted. The small-diameter portion 64*a* of the stepped bush 64 is inserted into the other of the shaft receivers 28. Thus, the main shaft 30 is rotatably mounted to the frame 26 through the shaft receivers 28.

The bobbin 32 includes a bobbin body 68 and a pair of flanges 70. The bobbin body 68 and the flanges 70 are each formed from a metal. The bobbin body 68 has such a shape that a cylindrical side surface is cut out in the axial direction. The flanges 70 are each disc-shaped. The bobbin body 68 is positioned between the paired flanges 70. The flanges 70 have rotation stopping holes 72. Into the rotation stopping holes 72, the main shaft 30 is inserted to stop rotation. Thus, the bobbin 32 and the main shaft 30 can integrally rotate. A cushion rubber 74 is mounted to the bobbin body 68. The bobbin body 68 is covered with the cushion rubber 74. Into the bobbin body 68, the main shaft 30 is inserted. The bobbin 32 is positioned between the paired plates 56 of the frame 26.

The claw piece shaft 38 is a pin that is disposed so as to extend between the paired flanges 70. The claw piece shaft 38 is fixed to the pair of flanges 70. The claw piece shaft 38 is formed from a metal. The claw piece 40 is positioned between the bobbin 32 and the other of the plates 56 of the frame 26. One end portion of the claw piece 40 is attached to the claw piece shaft 38. The claw piece 40 is rotatable relative to the claw piece shaft 38. To the other end portion of the claw piece 40, one end of a coil spring 76 is attached. The other end of the coil spring 76 is attached to the flange 70. Thus, the other end portion of the claw piece 40 is rotated in the outer diameter direction due to a centrifugal force of rotation about the main shaft 30. To the other end portion having been rotated, a returning force in the inner diameter direction is applied due to the coil spring 76.

The claw piece receiving gear 42 is positioned between the bobbin 32 and the other of the plates 56 of the frame 26. The claw piece receiving gear 42 is fixed to the side surface, of the other of the plates 56, opposing the bobbin 32. The claw piece receiving gear 42 is fixed so as to be parallel to the flat surface of the other of the plates 56. The claw piece receiving gear 42 is formed as a metal plate. The claw piece receiving gear 42 has a hole 78 at the center thereof. In the radially inner side of the hole 78, the claw piece 40 is positioned. In the hole 78, a plurality of engagement portions 80 are provided so as to be engageable with the claw piece 40.

The spiral spring 34 is accommodated in the spring case 36. The outer diameter end of the spiral spring 34 is fixed to the spring case 36. The inner diameter end of the spiral spring 34 is latched in the groove 66 at the rear end of the main shaft 30. The spring case 36 is detachably mounted to one of the plates 56. The spiral spring 34 is formed from a metal. The spring case 36 is formed from a resin.

The stepped rivet 44 is another pin that is disposed so as to extend between the paired flanges 70. The stepped rivet 44 is extended and fixed between the paired flanges 70. One end of the stepped rivet 44 is fixed to one of the flanges 70. The other end of the stepped rivet 44 is fixed to the other of the flanges 70. The stepped rivet 44 is formed from a metal.

The cam 46, the fixing plate 50, and the plate spring 48 will be described with reference to FIG. 4 and FIG. 5. A rotation shaft 86 is fixed to the fixing plate 50. The cam 46 is rotatably mounted to the rotation shaft 86. As shown in FIG. 5, the cam 46 includes a locking engagement portion 82 and a waiting engagement portion 84. The locking engagement portion 82 includes a tip 82*a*. The tip 82*a* projects outward in the rotation radial direction. The waiting engagement portion 84 has a tip 84*a*. The tip 84*a* projects outward in the rotation radial direction. A straight line L1 passing through the tip 82*a* and the axial center of the rotation shaft 86 intersects a straight line L2 passing through the tip 84*a* and the axial center of the rotation shaft 86. In other words, the locking engagement portion 82 and the waiting engagement portion 84 are provided at different positions in the rotation direction. A double-headed arrow Dc in FIG. 5 represents a distance from the axial center of the rotation shaft 86 to the tip 82*a* of the locking engagement portion 82. The cam 46 and the rotation shaft 86 are each formed from, for example, a resin.

Figure 4:
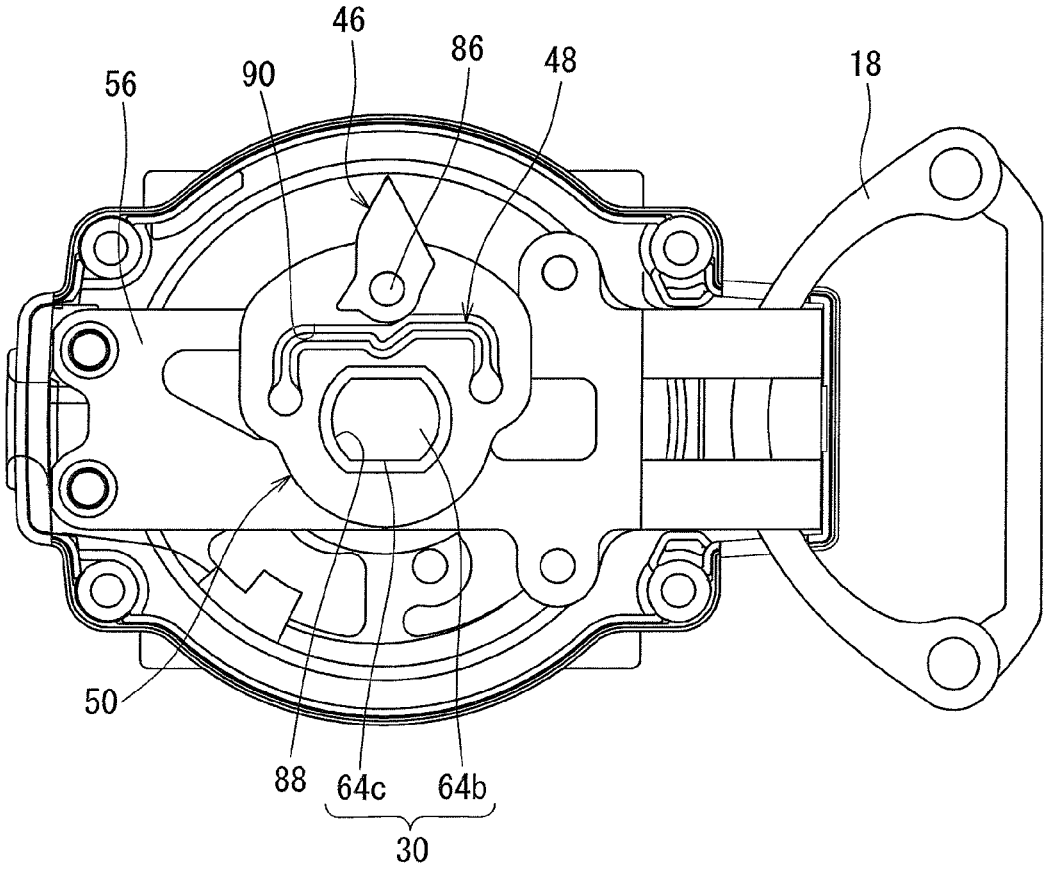
FIG. 4 illustrates a portion of an internal structure of the reel shown in FIG. 2.
Figure 5:
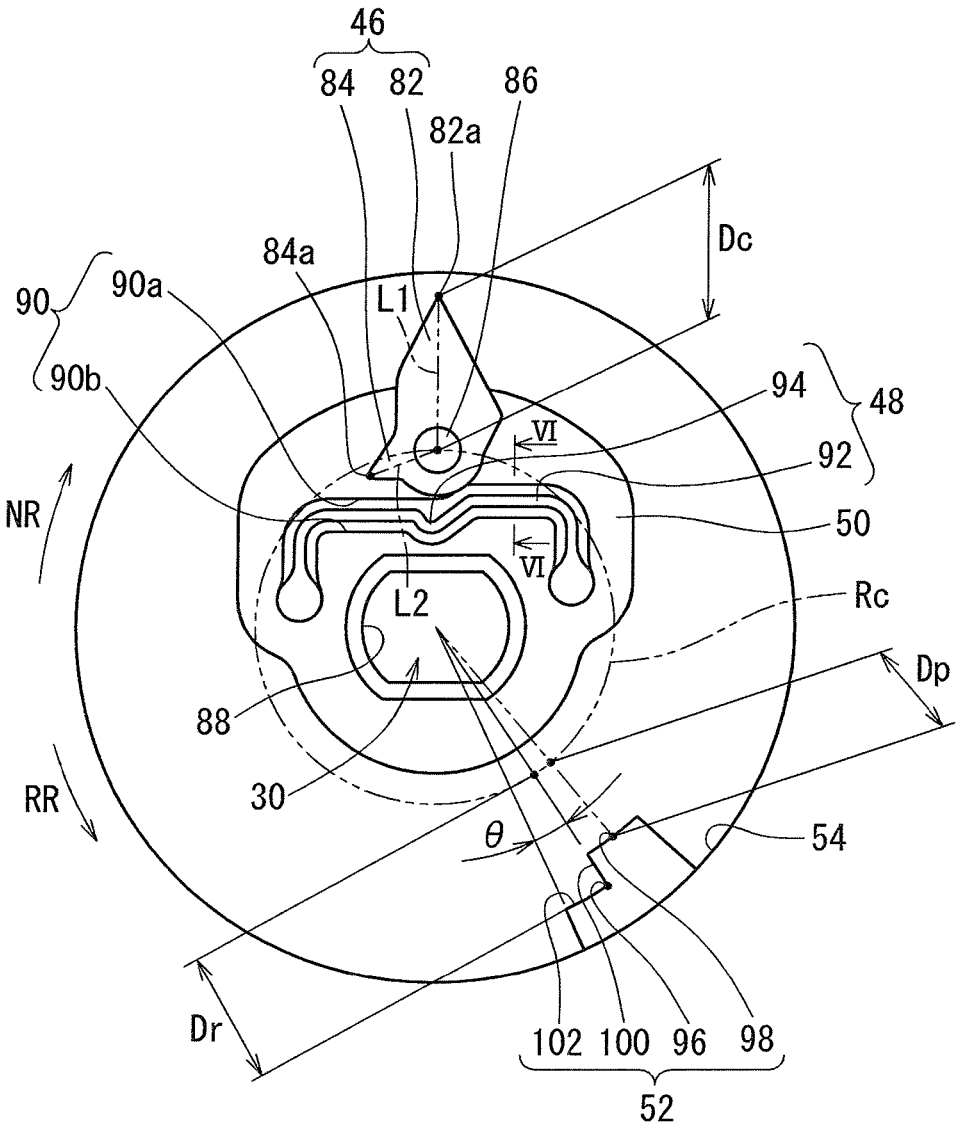
FIG. 5 illustrates a state where the reel shown in FIG. 2 is used.

As shown in FIG. 4, the fixing plate 50 has a shaft hole 88 and a groove 90. The groove 90 is formed between the rotation shaft 86 and the shaft hole 88. The groove 90 extends so as to be elongated, bent, and almost U-shaped. The groove 90 is bent so as to project from the shaft hole 88 toward the rotation shaft 86. The fixing plate 50 is formed from, for example, a resin. The large-diameter portion 64*b* of the main shaft 30 is fitted into the shaft hole 88, and the fixing plate 50 is fixed to the main shaft 30.

As shown in FIG. 5, the plate spring 48 includes a bent portion 92 that projects, between both end portions of the plate spring 48, toward the cam 46. An engagement recess 94 is formed in the bent portion 92 of the plate spring 48. The engagement recess 94 functions as an engagement portion that engages with the waiting engagement portion 84 of the cam 46. Both the end portions of the plate spring 48 are fixed to the fixing plate 50.

Figure 6:
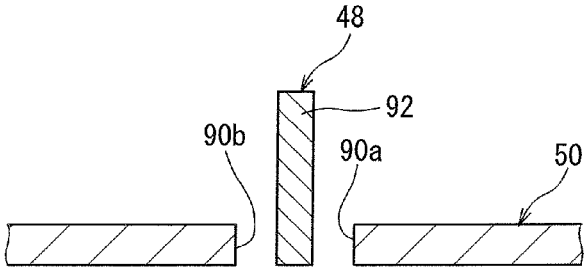
FIG. 6 is a cross-sectional view taken along a line VI-VI of FIG. 5.

FIG. 6 shows a cross-section taken along a line VI-VI in FIG. 5. The bent portion 92 of the plate spring 48 is positioned between a pair of wall surfaces 90*a* and 90*b* of the groove 90. Thus, the plate spring 48 extends from one end thereof to the other end thereof along the groove 90. In other words, the pair of wall surfaces 90*a* and 90*b* of the groove 90 extends along one end to the other end of the plate spring 48. A portion, of the bent portion 92, extending in the longitudinal direction may be positioned between the wall surface 90*a* and the wall surface 90*b*, which is not shown.

An alternate long and two short dashes line Rc in FIG. 5 represents a trajectory of the axial center of the rotation shaft 86, which is obtained when the rotation shaft 86 rotates together with the bobbin 32 (the main shaft 30). The cam receiver 52 includes a latching portion 96, a projecting portion 98, a guiding surface 100, and a support surface 102. In the cam receiver 52, the latching portion 96 is a recess formed by the guiding surface 100 and the support surface 102 intersecting each other. The projecting portion 98 projects in the radial direction toward the main shaft 30, that is, toward the rotation shaft 86. At the projecting portion 98, a distance from the trajectory Rc is minimum in the cam receiver 52. In the cam receiver 52, the projecting portion 98 is formed as a surface opposing the rotation shaft 86.

A double-headed arrow Dp in FIG. 5 represents a distance between the trajectory Rc and the projecting portion 98. The distance Dp is a minimum distance in the radial direction from the projecting portion 98 to the axial center of the rotation shaft 86. The distance Dp is a distance from the projecting portion 98 to the axial center of the rotation shaft 86, which is obtained when the axial center of the main shaft 30, the axial center of the rotation shaft 86, and the projecting portion 98 are aligned with each other so as to form a straight line. A double-headed arrow Dr represents a minimum distance between the trajectory Rc and the latching portion 96. The distance Dr is a minimum distance in the radial direction from the latching portion 96 to the axial center of the rotation shaft 86. The distance Dr is longer than the distance Dp. The latching portion 96 is farther, in the radial direction, from the rotation shaft 86 than the projecting portion 98 is.

An arrow NR and an arrow RR in FIG. 5 represent directions in which the bobbin 32 rotates. The arrow NR represents one direction in which the strap 22 is extracted. The arrow RR represents the other direction in which the strap 22 is wound. The guiding surface 100 is positioned between the projecting portion 98 and the latching portion 96 in the radial direction. The guiding surface 100 is a surface that extends continuously from the latching portion 96. The guiding surface 100 faces in the direction from which the cam 46 approaches the guiding surface 100 when the bobbin 32 rotates in the direction indicated by the arrow RR.

The support surface 102 is a surface that extends continuously from the latching portion 96 in the direction indicated by the arrow NR. A double-headed arrow θ in FIG. 5 represents a width of the support surface 102. The width is represented as an angle in the direction in which the bobbin 32 rotates. In the cam receiver 52, the support surface 102 extends along the direction in which the bobbin 32 rotates.

The cam 46 shown in FIG. 5 is rotatable in any of rotation directions. An orientation of the cam 46 shown in FIG. 5 represents a free orientation. The cam 46 is rotatable in any of directions in which the bobbin 32 rotates.

Figure 7:
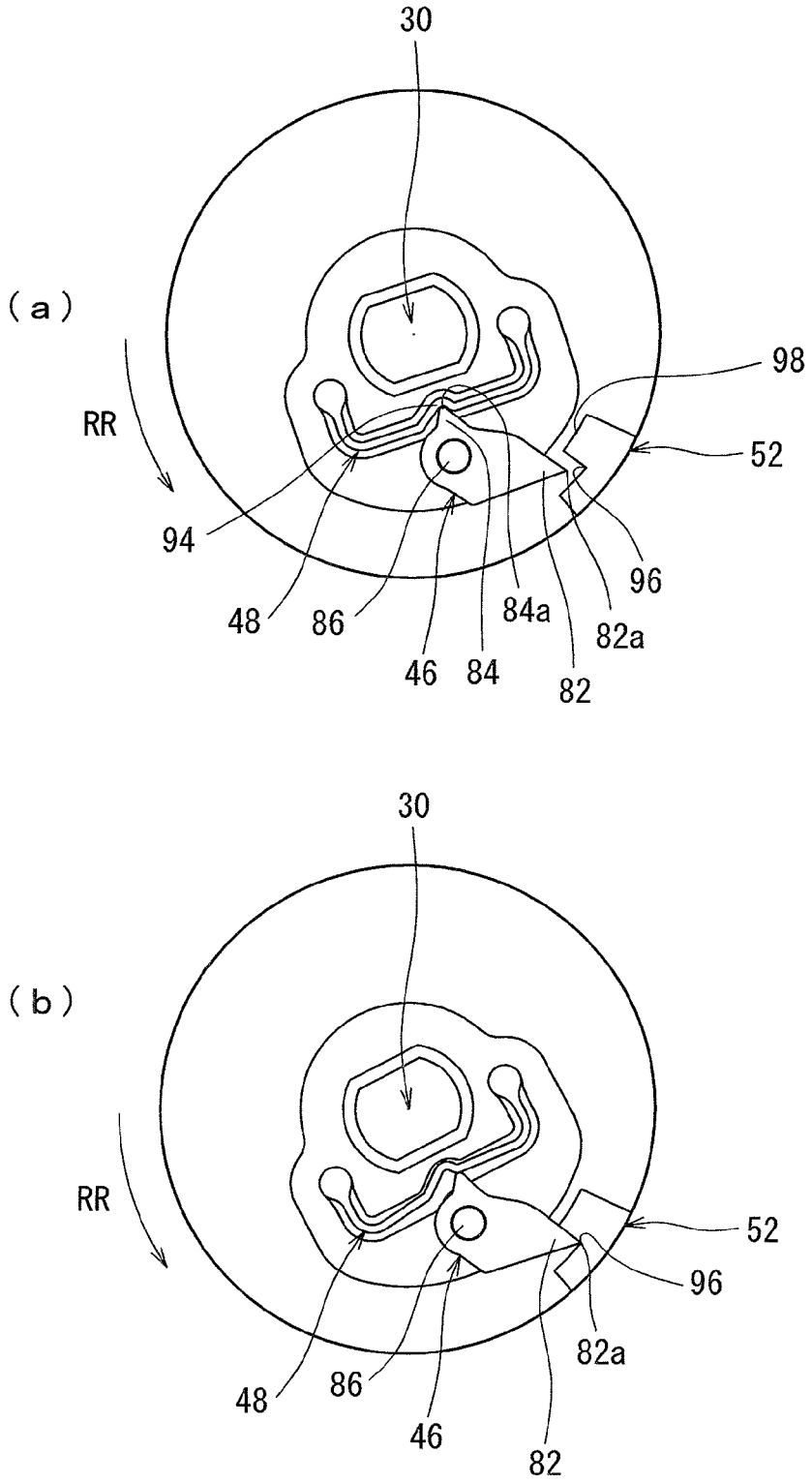
FIG. 7 illustrates another state where the reel shown in FIG. 2 is used.

FIG. 7(*a*) illustrates the cam 46 in the waiting orientation. In this orientation, the tip 84*a* of the waiting engagement portion 84 engages with the engagement recess 94 of the plate spring 48. The waiting engagement portion 84 engages with the plate spring 48. Thus, the orientation of the cam 46 is maintained constant in the rotation direction. In this orientation, the tip 82*a* of the locking engagement portion 82 is oriented in a direction in which the tip 82*a* approaches the cam receiver 52 when the rotation in the direction indicated by the arrow RR is performed. In this orientation, the tip 82*a* is positioned between the projecting portion 98 and the latching portion 96 in the radial direction.

FIG. 7(*b*) illustrates the cam 46 in a locking orientation. In this orientation, the tip 82*a* of the locking engagement portion 82 engages with the latching portion 96. The locking engagement portion 82 engages with the cam receiver 52. In this orientation, the tip 82*a* of the locking engagement portion 82 is oriented in the direction in which the tip 82*a* approaches the cam receiver 52 when the rotation in the direction indicated by the arrow RR is performed. In the locking orientation, the cam 46 and the plate spring 48 are disengaged from each other. The cam 46 is urged by the plate spring 48 in a rotation direction in which the cam 46 is changed from the locking orientation to the free orientation.

Figure 8:
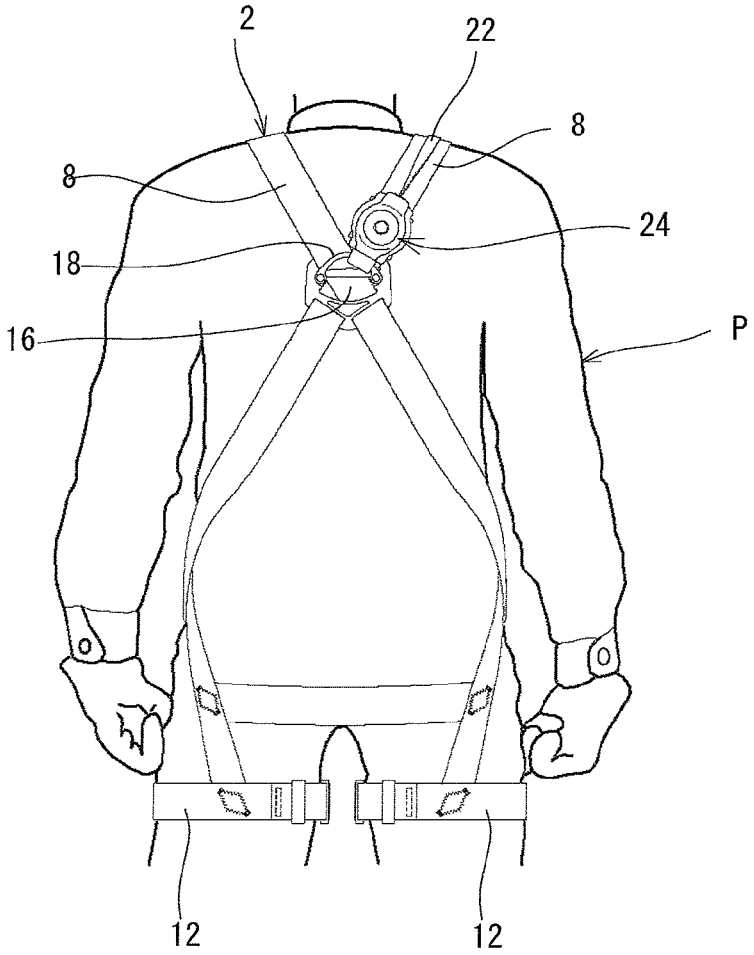
FIG. 8 illustrates a state where the safety belt shown in FIG. 1 is used.

FIG. 8 illustrates a state where a worker P wears the harness type safety belt 2. The paired shoulder belts 8 are hung on the shoulders of the worker. The thighs pass through the paired thigh belts 12, respectively. The hook 20 connected to the strap 22 is latched by a structure or a lifeline, which is not shown.

If a worker falls from a high place, shock is dispersed over a portion from shoulders to thighs by the harness type safety belt 2. Therefore, load on the worker is reduced. Since the reel 24 is positioned in the worker's back portion, the worker in a suspended state is less likely to be in an unnatural body positioning state. Further, since the reel 24 is positioned in the worker's back portion, the strap 22 or the reel 24 does not interfere with the work.

Figure 9:
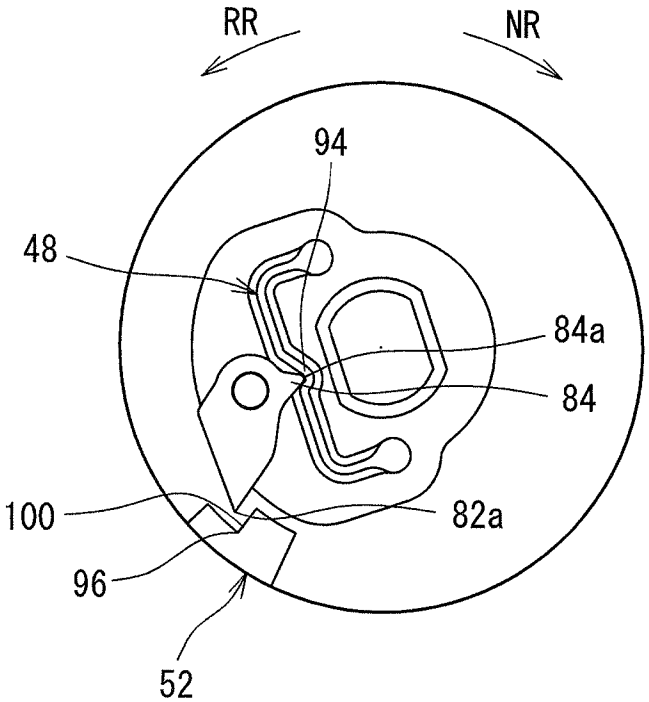
FIG. 9 illustrates still another state where the reel shown in FIG. 2 is used.
Figure 9:
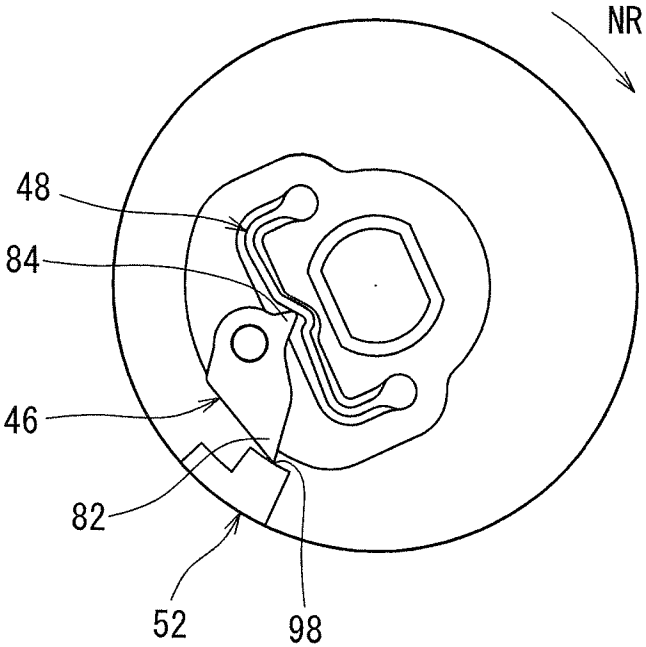

A method for operating the reel 24 will be described with reference to FIG. 9 to FIG. 11. A worker extracts the strap 22 from the reel 24 in a state where the cam 46 is in the free orientation (the state shown in FIG. 5). The bobbin 32 rotates in one direction (the direction indicated by the arrow NR) by this extraction. As shown in FIG. 9(*a*), the locking engagement portion 82 of the cam 46 contacts with the projecting portion 98, to rotate the cam 46. The waiting engagement portion 84 contacts with the plate spring 48, to elastically deform the plate spring 48. The cam 46 moves over the projecting portion 98. The cam 46 is urged in such a direction that the plate spring 48 having been elastically deformed is restored to an original shape.

As shown in FIG. 9(*b*), the cam 46 rotates due to the urging force of the plate spring 48, and the tip 84*a* of the waiting engagement portion 84 engages with the engagement recess 94 of the plate spring 48. When the strap 22 is thus extracted, the orientation of the cam 46 is changed from the free orientation to the waiting orientation.

When the strap 22 is further extracted, the cam 46, which is in the waiting orientation, repeatedly changes its orientation between an orientation (see FIG. 9(*a*)) in which the locking engagement portion 82 of the cam 46 contacts with the projecting portion 98 to rotate, and the waiting orientation (see FIG. 9(*b*)). Thus, the strap 22 can be extracted until a predetermined length of the strap 22 is extracted.

The worker stops extracting the strap 22. The bobbin 32 is rotated in the other direction (the direction indicated by the arrow RR) due to an urging force of the spiral spring 34 (see FIG. 3). The tip 82*a* of the locking engagement portion 82 of the cam 46 contacts with the guiding surface 100. The tip 82*a* of the locking engagement portion 82 is guided toward the latching portion 96 according to the bobbin 32 rotating in the other direction. Due to this guiding, the tip 82*a* is latched by the latching portion 96. As shown in FIG. 10(*a*), the orientation of the cam 46 is changed from the waiting orientation to the locking orientation.

In the reel 24, the distance Dc from the axial center of the rotation shaft 86 to the tip 82*a* of the locking engagement portion 82 is longer than the distance Dr in the radial direction from the axial center of the rotation shaft 86 to the latching portion 96. Thus, in the locking orientation shown in FIG. 10(*a*), rotation of the cam 46 is prevented. The prevention of the rotation of the cam 46 prevents rotation of the bobbin 32 in the other direction (the direction indicated by the arrow RR). Thus, the rotation of the bobbin 32 in the other direction is prevented. In the locking orientation, the winding of the strap 22 is prevented against the urging force of the spiral spring 34.

Figure 10:
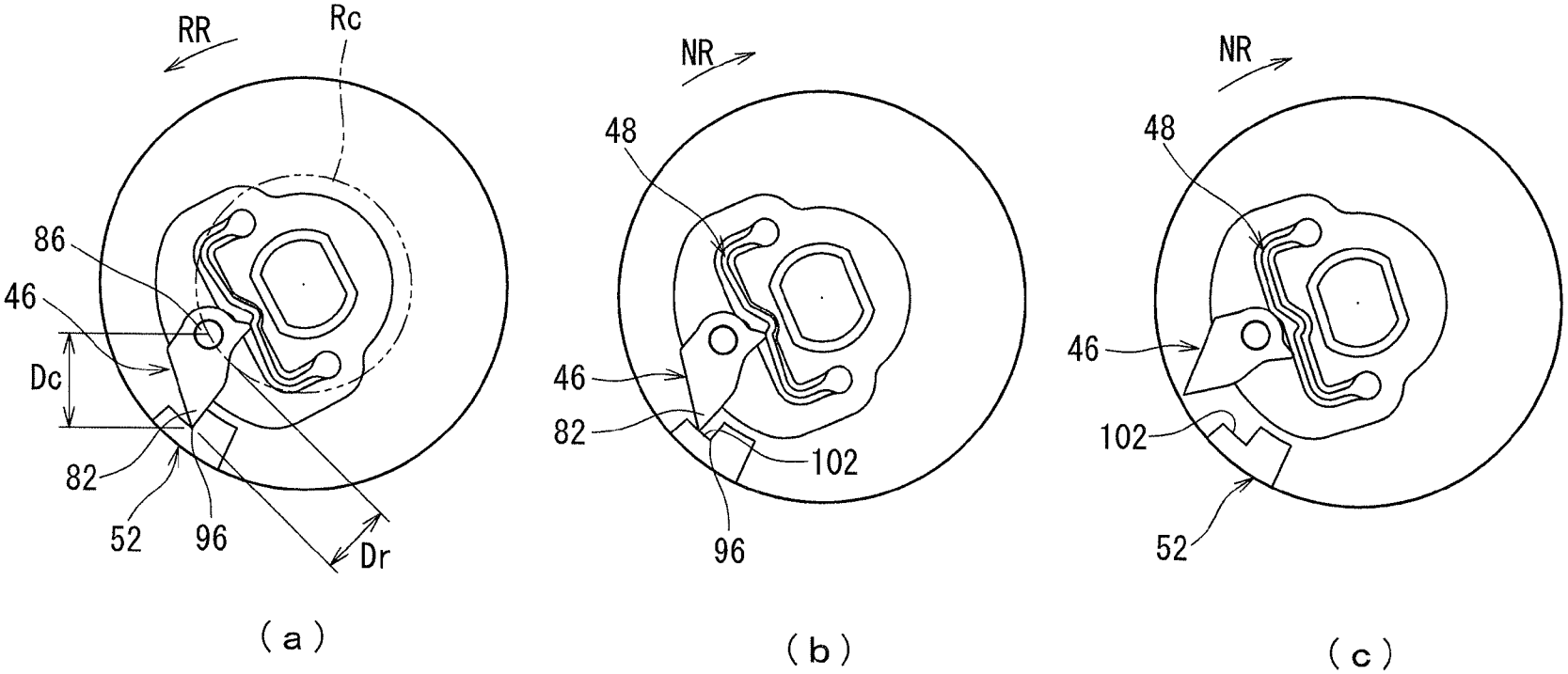
FIG. 10 illustrates still another state where the reel shown in FIG. 2 is used.

In the state shown in FIG. 10(*a*), the worker is allowed to work in a state where the strap 22 is extracted so as to have an appropriate length for the work range. During the work, the strap 22 is not pulled due to the urging force of the spiral spring 34. Interference with the work due to the strap 22 being pulled is reduced.

When a work range is changed, the strap 22 is extracted from the reel 24 by the worker such that the state shown in FIG. 10(*a*) is changed through the state shown in FIG. 10(*b*) to the state shown in FIG. 10(*c*). The supporting of the tip 82*a* of the locking engagement portion 82 by the support surface 102 is cancelled, and the strap 22 is extracted. By the supporting by the support surface 102 being cancelled, the cam 46 is rotated by the plate spring 48 to be in the free orientation. Thus, as shown in FIG. 10(*c*), the orientation of the cam 46 is returned to the free orientation.

The worker stops extracting the strap 22. The bobbin 32 is rotated in the other direction due to the urging force of the spiral spring 34. The strap 22 is wound. As shown in FIG. 11(*a*), rotation in the direction indicated by the arrow RR causes contact of the cam 46 with the cam receiver 52. The cam 46 in the free orientation is rotated by the cam receiver 52. As shown in FIG. 11(*b*), the locking engagement portion 82 contacts with the projecting portion 98 of the cam receiver 52, and the cam 46 is further rotated. The cam 46 having been rotated, contacts with the bent portion 92. The plate spring 48 prevents rotation of the cam 46 and further urges the cam 46 in such a rotation direction that the cam 46 is returned to the free orientation. When the bobbin 32 rotates in the direction indicated by the arrow RR, the orientation of the cam 46 is changed among the orientations shown in FIG. 11(*a*), FIG. 11(*b*), and FIG. 11(*c*), and the locking engagement portion 82 moves over the projecting portion 98.

Figure 11:
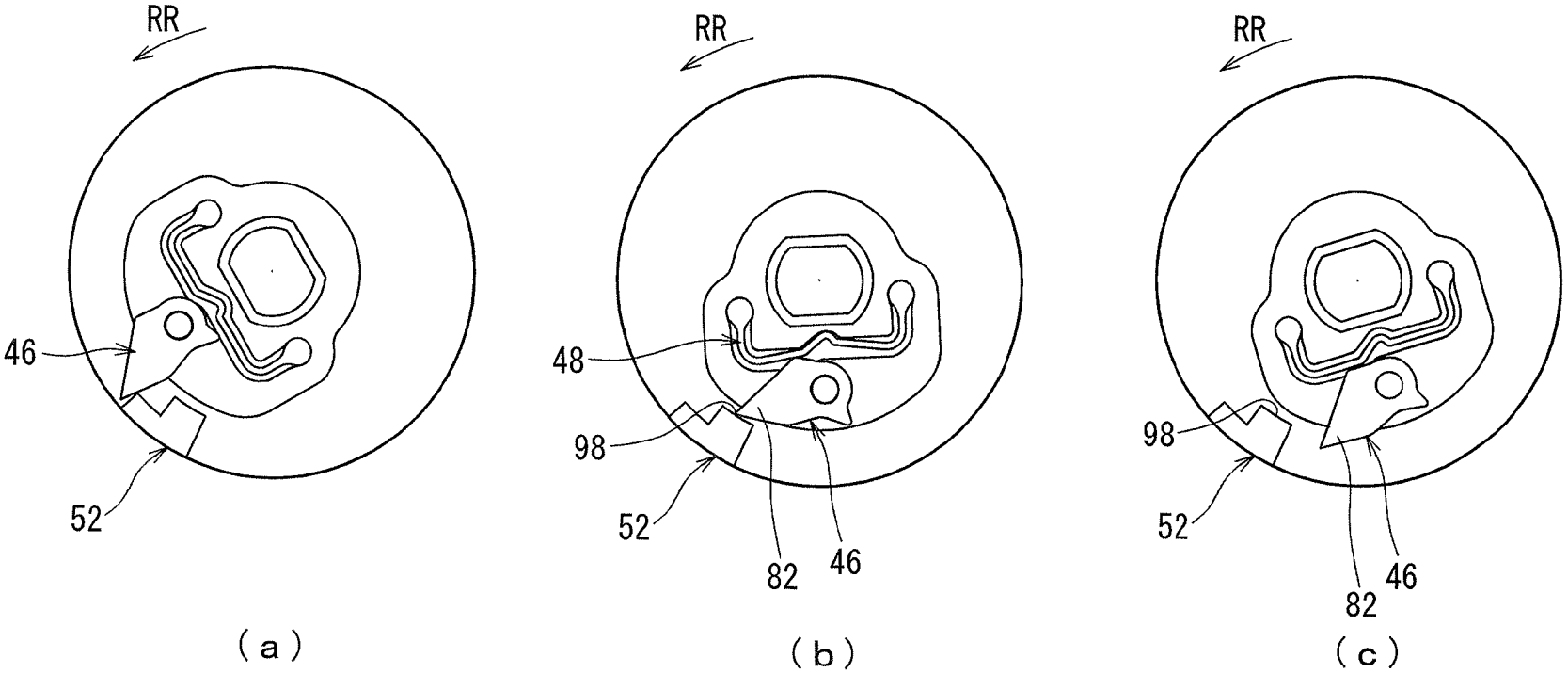
FIG. 11 illustrates still another state where the reel shown in FIG. 2 is used.

When the bobbin 32 further rotates in the direction indicated by the arrow RR, the state of the cam 46 is changed from the state shown in FIG. 11(*c*) so as to be returned through the state shown in FIG. 5 and the states shown in FIG. 11(*a*) and FIG. 11(*b*) to the state shown in FIG. 11(*c*). The cam 46 in the free orientation repeatedly changes its orientation among the states shown in FIG. 5, and FIG. 11(*a*) to FIG. 11(*c*), and the bobbin 32 rotates in the other direction due to the urging force of the spiral spring 34. The strap 22 is wound. Slack of the strap 22 is removed.

When the worker reaches the subsequent work range, the strap 22 is extracted from the reel 24. The bobbin 32 rotates in one direction (the direction indicated by the arrow NR) by this extraction. As shown in FIG. 9(*a*), the locking engagement portion 82 of the cam 46 contacts with the projecting portion 98, to rotate the cam 46. The waiting engagement portion 84 contacts with the plate spring 48, to elastically deform the plate spring 48. The cam 46 moves over the projecting portion 98. The cam 46 is urged in such a direction that the plate spring 48 having been elastically deformed is restored to the original shape.

As shown in FIG. 9(*b*), the cam 46 rotates due to the urging force of the plate spring 48, and the tip 84*a* of the waiting engagement portion 84 engages with the engagement recess 94 of the plate spring 48. When the strap 22 is thus extracted, the orientation of the cam 46 is changed from the free orientation to the waiting orientation.

When the strap 22 is further extracted, the cam 46, which is in the waiting orientation, repeatedly changes its orientation between the orientation (see FIG. 9(*a*)) in which the locking engagement portion 82 of the cam 46 contacts with the projecting portion 98 to rotate, and the waiting orientation (see FIG. 9(*b*)). Thus, the strap 22 is extracted until a predetermined length of the strap 22 is extracted.

The worker stops extracting the strap 22. The bobbin 32 is rotated in the other direction (the direction indicated by the arrow RR) due to an urging force of the spiral spring 34. The tip 82*a* of the locking engagement portion 82 of the cam 46 contacts with the guiding surface 100. The tip 82*a* of the locking engagement portion 82 is guided toward the latching portion 96 according to the bobbin 32 rotating in the other direction. Due to this guiding, the tip 82*a* is latched by the latching portion 96. In this manner, as shown in FIG. 10(*a*), the orientation of the cam 46 is changed from the waiting orientation to the locking orientation.

In the reel 24, the winding of the strap 22 is prevented and the prevention of the winding of the strap 22 is cancelled by extraction of the strap 22. Switching between the prevention of the winding of the strap 22 and the cancellation of the prevention of the winding of the strap 22 can be performed without touch on the reel 24. Due to this switching, unlike for the conventional reels, an operation of an operation lever is unnecessary. In the harness type safety belt 2, the reel 24 is positioned in the worker's back portion. However, the worker need not extend the worker's hand to the worker's back. In the reel 24, the prevention of winding of the strap 22 and the cancellation of the prevention of winding of the strap 22, are facilitated. In the reel 24, change of a length by which the strap 22 is extracted is also facilitated.

In the conventional reel described in Patent Literature 1, an engagement direction of the cam needs to be changed in order to cancel the prevention of the winding. The cam needs to be aligned with a position at which a portion of the ratchet toothed member is cut out, in order to change the engagement direction. On the other hand, in the reel 24, the cam 46 which has been changed into the waiting orientation by the strap 22 being extracted, is maintained in the waiting orientation until the strap 22 is wound and the locking orientation is entered. Thus, the cam 46 need not be aligned with a specific position in order to change the orientation of the cam 46. The prevention of the winding of the strap 22 and the cancellation of the prevention of the winding of the strap 22 are further facilitated.

In the reel 24, when the strap 22 is slightly extracted, the bobbin 32 rotates in one direction (the direction indicated by the arrow NR) in the locking orientation shown in FIG. 10(*a*). As shown in FIG. 10(*b*), the tip 82*a* of the locking engagement portion 82 of the cam 46 is moved away from the latching portion 96 in the direction indicated by the arrow NR. The plate spring 48 urges the cam 46 in such a direction as to rotate the cam 46 into the free orientation. The support surface 102 supports, against the urging force of the plate spring 48, the tip 82*a* of the locking engagement portion 82 so as to orient the tip 82*a* in a direction toward the latching portion 96.

Even if the strap 22 is erroneously extracted in the state shown in FIG. 10(*a*) during work, a state is returned from the state shown in FIG. 10(*b*) to the state shown in FIG. 10(*a*) by the strap 22 being wound. In the reel 24, even when the strap 22 is slightly extracted by error, the cam 46 is returned to the locking orientation. The strap 22 is returned to a state where the wining is prevented.

By the support surface 102, the winding of the strap 22 is prevented even when the strap 22 is slightly extracted by error. In this viewpoint, the angle θ representing the width of the support surface 102 in the rotation direction of the bobbin 32 is preferably greater than or equal to 5°, and more preferably greater than or equal to 10°.

On the other hand, in the reel 24 in which the angle θ representing the width of the support surface 102 is small, prevention of winding of the strap 22 is cancelled by the strap 22 being slightly extracted. The switching from the state in which winding of the strap 22 is prevented, to the winding state, can be facilitated. In this viewpoint, the angle θ is preferably not greater than 30°, and more preferably not greater than 20°.

The harness type safety belt 2 is used such that the strap 22 is made slack to some degree, while a worker works. From the viewpoint that erroneous cancellation of prevention of winding of the strap 22 is avoided, a length by which the strap 22 is extracted in a tensioned state is greater than or equal to 2 mm, and more preferably greater than or equal to 3 mm. On the other hand, from the viewpoint that switching of the strap 22 from the winding prevention state to the winding state is facilitated, a length by which the strap 22 is extracted in the tensioned state is not greater than 18 mm, and more preferably not greater than 11 mm.

In the reel 24, when the bobbin 32 is rotated in the other direction (the direction indicated by the arrow RR), the tip 82*a* of the locking engagement portion 82 of the cam 46 in the waiting orientation is guided toward the latching portion 96 (see FIG. 7(*a*) and FIG. 7(*b*)). From the viewpoint that the tip 82*a* of the locking engagement portion 82 is easily guided to the latching portion 96, the guiding surface 100 preferably extends in the radial direction of the bobbin 32 (see FIG. 5). Also from the viewpoint that engagement between the tip 82*a* of the locking engagement portion 82 and the latching portion 96 is assuredly maintained, the guiding surface 100 preferably extends in the radial direction of the bobbin 32.

Thus, from the viewpoint that the tip 82*a* of the locking engagement portion 82 is guided, and engagement with the latching portion 96 is assuredly maintained, the guiding surface 100 more preferably extends so as to be tilted from one side toward the other side in the rotation direction of the bobbin 32, in the direction in which the distance from the rotation shaft 86 is increased in the radial direction.

In the reel 24, the rotation shaft 86 of the cam 46 and the plate spring 48 are formed integrally with the fixing plate 50. Therefore, relative positions between the cam 46 and the plate spring 48 are easily determined.

In the plate spring 48, the bent portion 92 between both of the fixed end portions of the plate spring 48 is elastically deformed due to contact with the cam 46. In the plate spring 48, the entirety of the bent portion 92 is elastically deformed, whereby restoring property is excellent. The plate spring 48 is excellent in durability.

The plate spring 48 is positioned between the paired wall surfaces 90*a* and 90*b* of the groove 90. Therefore, when elastic deformation of the plate spring 48 is increased, the plate spring 48 contacts with the wall surface 90*a* or the wall surface 90*b*. Elastic deformation of the plate spring 48 is restricted by the pair of wall surfaces 90*a* and 90*b*. In other words, deformation of the plate spring 48 is restricted due to the groove 90. The groove 90 functions as a stopper. In the description herein, the groove 90 is illustrated as the stopper. However, the stopper is not limited to the groove 90. The stopper may function to restrict deformation of the plate spring 48. For example, a pin that stands on the fixing plate 50, or the like may be used as the stopper. Since the elastic deformation is restricted, the plate spring 48 is further excellent in durability. Further, since the elastic deformation of the plate spring 48 is restricted, a range in which the cam 46 rotates is restricted. When the range in which the cam 46 rotates is restricted, an orientation of the cam 46 can be easily changed among the free orientation, the waiting orientation, and the locking orientation.

The pair of wall surfaces 90*a* and 90*b* of the groove 90 extends along one end to the other end of the plate spring 48. Therefore, the elastic deformation is restricted in a range from one end to the other end of the plate spring 48. In a wide range in the longitudinal direction, elastic deformation is restricted. Therefore, in the reel 24, the plate spring 48 is excellent particularly in durability.

Further, since the plate spring 48 is formed integrally with the fixing plate 50, a distance between the plate spring 48 and the pair of wall surfaces 90*a* and 90*b* can be easily controlled so as to be constant. When the distance is controlled so as to be constant, elastic deformation of the plate spring 48 can be controlled so as to be constant. The integration of the plate spring 48 with the fixing plate 50 can contribute to improvement of durability of the plate spring 48.

In the reel 24, the bobbin 32 is urged by the spiral spring 34 and rotated in the other direction, and an excessively slacked portion of the strap 22 is wound. The strap 22 is caused to have a length including an appropriate slack for work, and the cam 46 and the cam receiver 52 engage with each other. If a worker falls from a high place, the strap 22 is rapidly extracted. Thus, the bobbin 32 is rapidly rotated. Due to the rapid rotation of the bobbin 32, a centrifugal force is applied to the claw piece 40 shown in FIG. 3. The other end portion of the claw piece 40 is rotated, against an urging force of the coil spring 76, outward in the radial direction. The claw piece 40 engages with the engagement portions 80 of the claw piece receiving gear 42. The rotation of the bobbin 32 is prevented. Extraction of the strap 22 is prevented. In the reel 24, the spiral spring 34, the engagement between the claw piece 40 and the claw piece receiving gear 42, and engagement between the cam 46 and the cam receiver 52 are combined, to minimize a distance by which the worker falls. Further, due to this combination, interference of the strap 22 with working efficiency is reduced.

Although the lanyard 6 is attached to the harness 4, the lanyard 6 may be used for safety waist belts. Also in the safety waist belts, operations for preventing winding of the strap 22 and cancelling the prevention of winding of the strap 22 are facilitated.

In the reel 24, the cam receiver 52 is fixed to the case 54. However, the cam receiver 52 may be fixed to the frame 26. The cam receiver 52 and the frame 26 may be fixed with respect to the cam 46 that rotates together with the bobbin 32. In the reel 24, since the cam receiver 52 is formed integrally with the case 54, the cam receiver 52 can be easily produced. Further, in the reel 24, since the case 54 is formed from a resin, the cam receiver 52 can be formed integrally with the case 54.

The reel 24 is shaped so as to allow the cam 46 and the cam receiver 52 to be disposed between the case 54 and the frame 26. Therefore, a case of a conventional reel can be replaced with the case 54, and the cam 46 and the cam receiver 52 can be additionally mounted to the conventional reel. By changing components, the conventional reel can be easily modified as the reel of the present invention.

In the description herein, the cam 46 is rotatably fixed to the main shaft 30 that rotates integrally with the bobbin 32. However, the cam 46 may be rotatably fixed to the bobbin 32. The fixing plate 50 may be fixed to the bobbin 32.

The reel 24 in which the cam 46 and the plate spring 48 rotate together with the bobbin 32 is illustrated. However, the cam receiver 52 may rotate together with the bobbin 32. The cam receiver 52 may be fixed to the bobbin 32, or to the main shaft 30 that rotates together with the bobbin 32. The cam 46 and the plate spring 48 may be mounted to the frame 26 or the case 54.

Figure 12:
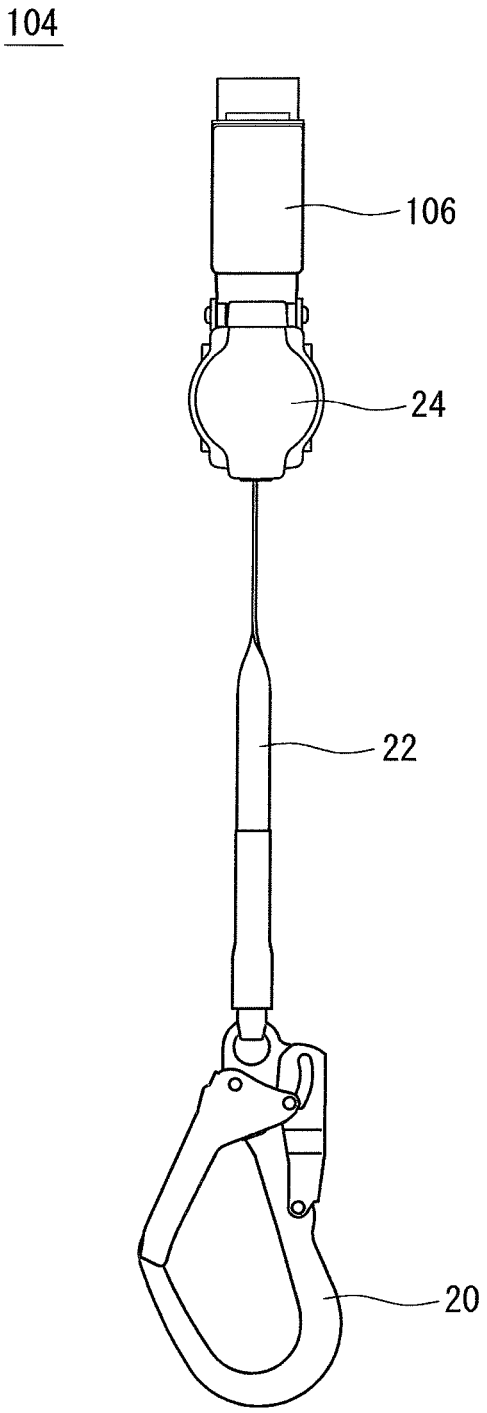
FIG. 12 is a front view of a lanyard according to another embodiment of the present invention.

FIG. 12 illustrates another lanyard 104 according to the present invention. The lanyard 104 includes a shock absorber 106. The other components are the same as those of the lanyard 6. The components different from those of the lanyard 6 will be described below, and description of the same components therebetween is not given. Further, the same components as those of the lanyard 6 are denoted by the same reference numerals.

The lanyard 104 includes the hook 20, the strap 22, the reel 24, and the shock absorber 106. Through the shock absorber 106, the lanyard 104 is connected to a safety belt. If a worker falls, the shock absorber 106 reduces shock of the fall in the safety belt including the lanyard 104. When the safety belt is used, a falling distance is increased by a distance corresponding to the shock absorber 106. However, shock, on the worker, of fall is reduced.

Figure 13:
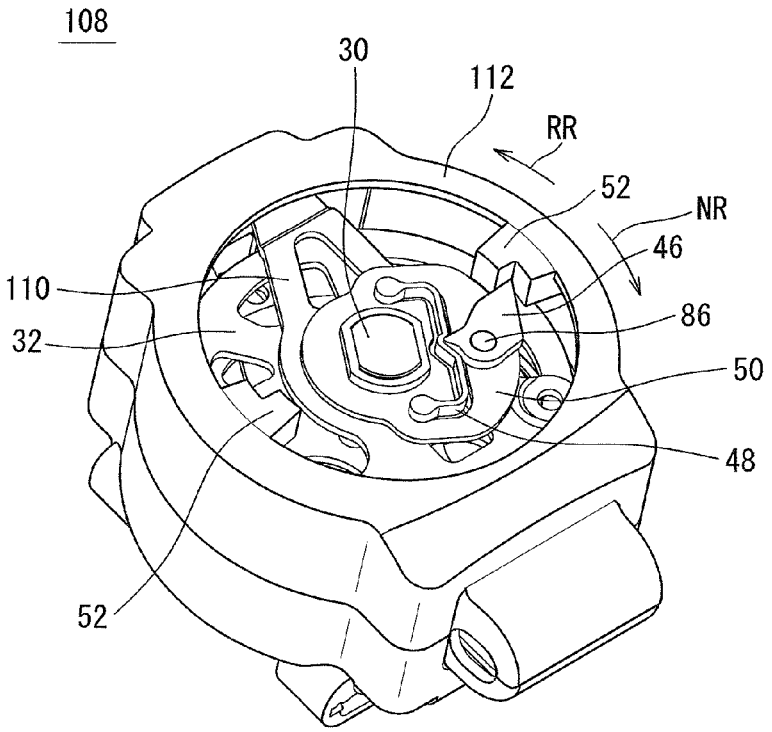
FIG. 13 is a perspective view of a reel of a safety belt according to still another embodiment of the present invention.

Similarly to the reel 24, a reel 108 shown in FIG. 13 is used for the lanyard and the safety belt according to the present invention. The reel 108 includes a frame 110, a case 112, and a pair of the cam receivers 52. The frame 110, the case 112, and the pair of the cam receivers 52 are different from those of the reel 24. The other components are the same as those of the reel 24. In FIG. 13, in order to illustrate the internal structure, a portion of the case 112 is cut out. Components different from those of the reel 24 will be described below. Description of the same components as those of the reel 24 is not given. Further, the same components as those of the reel 24 are denoted by the same reference numerals.

An arrow NR in FIG. 13 represents one rotation direction in which the strap 22 is extracted. An arrow RR represents the other rotation direction in which the strap 22 is wound. In FIG. 13, similarly to the cam receiver 52 of the reel 24, the paired cam receivers 52 each include the latching portion 96, the projecting portion 98, the guiding surface 100, and the support surface 102, which are not denoted by the reference numerals. In the reel 108, the pair of the cam receivers 52 is fixed to the case 112. The paired cam receivers 52 are point-symmetric with respect to the rotation center of the bobbin 32. The paired cam receivers 52 are positioned so as to oppose each other in the diameter direction of the bobbin 32. The paired cam receivers 52 are equally spaced from each other in the rotation direction of the bobbin 32.

In the reel 108, the pair of the cam receivers 52 are provided, to enable minute adjustment of a length by which the strap 22 is extracted, as compared to the reel 24. The number of the cam receivers 52 may be three or more. The three or more cam receivers 52 may be equally spaced from each other in the rotation direction of the bobbin 32. When a plurality of the cam receivers 52 are provided so as to be spaced from each other in the rotation direction, a length by which the strap 22 is extracted can be minutely adjusted.

Figure 14:
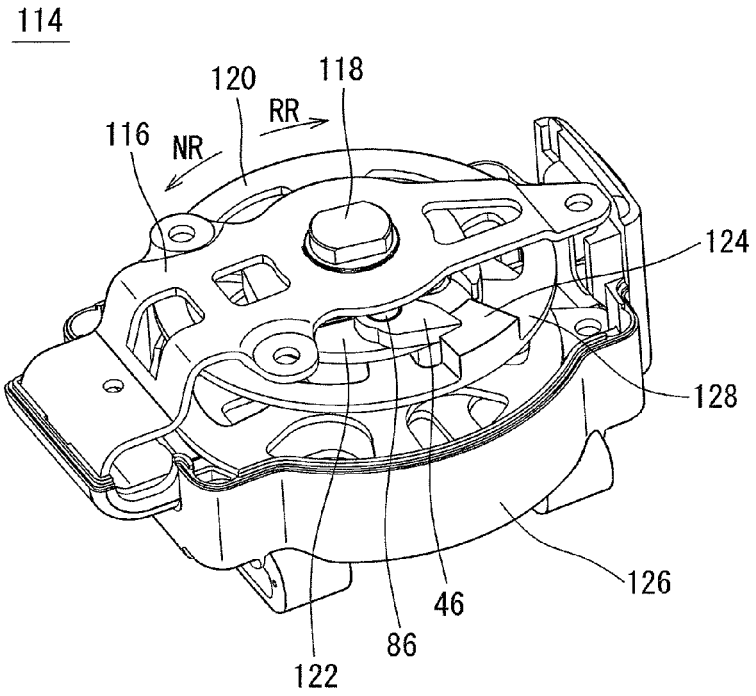
FIG. 14 is a perspective view of a reel of a safety belt according to still another embodiment of the present invention.

Similarly to the reel 24, a reel 114 shown in FIG. 14 is used for the lanyard and the safety belt according to the present invention. The reel 114 includes a frame 116, a main shaft 118, a bobbin 120, a fixing plate 122, a cam receiver 124, and a case 126. These components are different from those of the reel 24. The other components are the same as those of the reel 24. In FIG. 14, in order to illustrate the internal structure, a portion of the case 126 is omitted. The components different from those of the reel 24 will be described below. Description of the same components as those of the reel 24 is not given. Further, the same components as those of the reel 24 are denoted by the same reference numerals.

The main shaft 118 is fixed to the frame 116. The main shaft 118 and the frame 116 are integrated with each other. The bobbin 120 is rotatably mounted such that the main shaft 118 is a rotation shaft of the bobbin 120. The bobbin 120 is rotatable relative to the frame 116. An arrow NR in FIG. 14 represents one rotation direction in which the strap 22 is extracted. An arrow RR represents the other rotation direction in which the strap 22 is wound.

The fixing plate 122 is fixed to the main shaft 118. The fixing plate 122 and the main shaft 118 are provided integrally with the frame 116. To the fixing plate 122, the rotation shaft 86 is fixed. The cam 46 is rotatably mounted to the rotation shaft 86. The groove 90 is formed in the fixing plate 122, and the plate spring 48 is fixed therein, which is not shown.

In FIG. 14, similarly to the cam receiver 52, the cam receiver 124 includes the latching portion 96, the projecting portion 98, the guiding surface 100, and the support surface 102, which are not denoted by the reference numerals. The cam receiver 124 is fixed to the bobbin 120. In the reel 114, the cam receiver 124 is fixed to a flange 128 of the bobbin 120. Rotation of the bobbin 120 enables engagement between the cam receiver 124 and the cam 46, as in the reel 24. The case 126 is fixed integrally with the frame 116.

When the bobbin 120 rotates in one direction, the cam 46 is rotated by the projecting portion 98 to change its orientation from the free orientation to the waiting orientation. When the bobbin 120 rotates in the other direction, the tip 82*a* of the locking engagement portion 82 of the cam 46 in the waiting orientation is guided by the guiding surface 100, to change the cam 46 from the waiting orientation to the locking orientation. In the locking orientation, the cam 46 and the plate spring 48 which is not shown are disengaged from each other. The cam 46 is urged by the plate spring 48 in the rotation direction in which the locking orientation is changed to the free orientation.

DESCRIPTION OF THE REFERENCE CHARACTERS

2 . . . harness type safety belt
4 . . . harness
6, 104 . . . lanyard
10 . . . shoulder belt portion
14 . . . thigh belt portion
16 . . . intersecting portion
20 . . . hook
22 . . . strap
24, 108, 114 . . . reel
26, 110, 116 . . . frame
30, 118 . . . main shaft
32, 120 . . . bobbin
34 . . . spiral spring
36 . . . spring case
40 . . . claw piece
42 . . . claw piece receiving gear
46 . . . cam
48 . . . plate spring
50, 122 . . . fixing plate
52, 124 . . . cam receiver
54, 112, 126 . . . case
66 . . . groove
70, 128 . . . flange
80 . . . engagement portion
82 . . . locking engagement portion
84 . . . waiting engagement portion
86 . . . rotation shaft
88 . . . shaft hole
90 . . . groove
92 . . . bent portion
94 . . . engagement recess
96 . . . latching portion
98 . . . projecting portion
100 . . . guiding surface
102 . . . support surface
106 . . . shock absorber

The invention claimed is:

1. A lanyard comprising:
a hook;
a strap connected to the hook; and
a reel by which the strap is wound, wherein
the reel includes a bobbin, a frame, a cam, a cam elastic member, and a cam receiver,
the bobbin is rotatable, in a circumferential direction, relative to the frame, and the bobbin rotates in a first circumferential direction such that the strap is extracted, and rotates in a second circumferential direction to wind the strap,
one of the cam and the cam receiver is rotatable together with the bobbin, and the other of the cam and the cam receiver is integrated with the frame,
the cam includes a locking engagement portion and a waiting engagement portion,
the cam is rotatably supported, and a rotation shaft of the cam is disposed parallel to a rotation shaft of the bobbin,
the cam receiver includes a latching portion, a projecting portion, and a guiding surface,
the latching portion of the cam receiver is farther from the rotation shaft of the cam in a radial direction than the projection portion,
the guiding surface faces the first circumferential direction from which the cam approaches the guiding surface when the bobbin rotates in the second circumferential direction,
the cam is rotatable to change an orientation among a free orientation, a locking orientation, and a waiting orientation,
the free orientation represents an orientation in which the cam can be rotated in either the first or second circumferential directions,
the locking orientation represents an orientation in which a tip of the locking engagement portion is oriented in a direction toward the cam receiver when the bobbin rotates in the second circumferential direction, and the locking engagement portion engages with the latching portion of the cam receiver,
the waiting orientation represents an orientation in which the tip of the locking engagement portion is oriented in the direction toward the cam receiver when the bobbin rotates in the second circumferential direction, and the waiting engagement portion engages with the cam elastic member, when the bobbin rotates in one direction in the circumferential direction, the cam is rotated by the projecting portion, to change an orientation from the free orientation to the waiting orientation, when the bobbin rotates in the second circumferential direction, the tip of the locking engagement portion of the cam in the waiting orientation is guided by the guiding surface, to change the orientation from the waiting orientation to the locking orientation, in the locking orientation, the waiting engagement portion of the cam and the cam elastic member are disengaged from each other, and the cam is urged by the cam elastic member in a rotation direction in which the locking orientation is changed to the free orientation, and a distance from an axial center of the rotation shaft of the cam to the tip of the locking engagement portion is longer than a minimum distance, in the radial direction, from the axial center of the rotation shaft of the cam to the latching portion.

2. The lanyard according to claim 1, wherein the cam receiver includes a support surface, the support surface is formed so as to continuously connect to the latching portion, and the support surface supports the tip of the locking engagement portion so as to orient the tip in a direction toward the latching portion when the tip of the locking engagement portion of the cam that engages with the latching portion of the cam receiver, moves away from the latching portion in one direction in the circumferential direction.

3. The lanyard according to claim 1, wherein the guiding surface extends in the radial direction.

4. The lanyard according to claim 1, wherein the guiding surface extends so as to be titled from one side toward another side in the rotation direction of the bobbin, in a direction in which a distance from the rotation shaft is increased in the radial direction.

5. The lanyard according to claim 2, wherein an angle θ representing a width of the support surface in the rotation direction is greater than or equal to 5°, and not greater than 30°.

6. The lanyard according to claim 1, wherein the reel includes a fixing plate, the rotation shaft of the cam and the cam elastic member are fixed to the fixing plate, and one of the fixing plate and the cam receiver is rotatable integrally with the bobbin, and the other of the fixing plate and the cam receiver is integrated with the frame.

7. The lanyard according to claim 6, wherein the fixing plate includes a stopper, and the stopper restricts elastic deformation of the cam elastic member.

8. The lanyard according to claim 1, wherein both ends of the cam elastic member are fixed, and a bent portion is formed, in the cam elastic member, between both the ends so as to project toward the cam in the radial direction, and an engagement portion that engages with the cam is formed in the bent portion.

9. The lanyard according to claim 7, wherein the cam elastic member is a plate spring that extends between both ends of the cam elastic member, the stopper is a groove formed in the fixing plate, a pair of wall surfaces in the groove extends along one end to the other end of the plate spring, and the plate spring is positioned between the paired wall surfaces.

10. The lanyard according to claim 1, wherein the reel includes a case fixed integrally with the frame, and the cam receiver is integrated with the case.

11. The lanyard according to claim 1, wherein the two or more cam receivers are provided so as to be spaced from each other in the rotation direction.

12. A harness type safety belt, comprising a lanyard and a harness, wherein the lanyard includes: a hook; a strap connected to the hook; and a reel by which the strap is wound, the reel includes a bobbin, a frame, a cam, a cam elastic member, and a cam receiver, the bobbin is rotatable, in a circumferential direction, relative to the frame, and the bobbin rotates in a first circumferential direction such that the strap is extracted, and rotates in a second circumferential direction to wind the strap, one of the cam and the cam receiver is rotatable together with the bobbin, and the other of the cam and the cam receiver is integrated with the frame, the cam includes a locking engagement portion and a waiting engagement portion, the cam is rotatably supported, and a rotation shaft of the cam is disposed parallel to a rotation shaft of the bobbin, the cam receiver includes a latching portion, a projecting portion, and a guiding surface, the latching portion of the cam receiver is farther from the rotation shaft of the cam in a radial direction than the projecting portion is, the guiding surface is positioned between the projecting portion and the latching portion in the radial direction, and the guiding surface faces in a direction from which the cam approaches the guiding surface when the bobbin rotates in the second circumferential direction, the cam is rotatable to change an orientation among a free orientation, a locking orientation, and a waiting orientation, the free orientation represents an orientation in which the cam can be rotated in either the first or second circumferential directions, the locking orientation represents an orientation in which a tip of the locking engagement portion is oriented in a direction toward the cam receiver when the bobbin rotates in the second circumferential direction, and the locking engagement portion engages with the latching portion of the cam receiver, the waiting orientation represents an orientation in which the tip of the locking engagement portion is oriented in the direction toward the cam receiver when the bobbin rotates in the second circumferential direction, and the waiting engagement portion engages with the cam elastic member, when the bobbin rotates in one direction in the circumferential direction, the cam is rotated by the projecting portion, to change an orientation from the free orientation to the waiting orientation, when the bobbin rotates in the second circumferential direction, the tip of the locking engagement portion of the cam in the waiting orientation is guided by the guiding surface, to change the orientation from the waiting orientation to the locking orientation, in the locking orientation, the waiting engagement portion of the cam and the cam elastic member are disengaged from each other, and the cam is urged by the cam elastic member in a rotation direction in which the locking orientation is changed to the free orientation, a distance from an axial center of the rotation shaft of the cam to the tip of the locking engagement portion is longer than a minimum distance, in the radial direction, from the axial center of the rotation shaft of the cam to the latching portion, the harness includes a shoulder belt portion and a thigh belt portion, and the shoulder belt portion forms an intersecting portion by the shoulder belt portion making an intersection and overlap on a back portion, and the lanyard is connected to the intersecting portion of the harness.

* * * * *